US005644491A

United States Patent [19]

Fiske et al.

[11] Patent Number: 5,644,491

[45] Date of Patent: Jul. 1, 1997

[54] SELF CONTAINED MULTI-FUNCTION ENGINE MONITOR AND TIMER FOR PROVIDING ENGINE RUNNING TIME, JOB TIME, SERVICE TIME AND TACHOMETER FUNCTIONS

[75] Inventors: Kenton W. Fiske, Macedon; Edward G. Reehil, Shortsville; Herbert F. Ley, Farmington; David L. Sestito, Fairport, all of N.Y.

[73] Assignee: SenDEC Corporation, Fairport, N.Y.

[21] Appl. No.: 189,321

[22] Filed: Jan. 31, 1994

[51] Int. Cl.[6] ..... G06G 7/70

[52] U.S. Cl. ..... 364/431.04; 364/431.03; 364/551.01; 364/550; 324/392; 324/393; 324/399; 324/379; 324/160; 324/402; 324/166; 324/169; 73/117.3; 73/116; 73/118.1; 123/634

[58] Field of Search ..... 364/431.04, 431.03, 364/431.08, 431.01, 508, 557, 424.03, 550, 551.01, 431.02, 431.11–431.12; 324/391, 393, 399, 402, 378, 394, 149, 156, 379, 395, 115, 642, 160, 392, 384; 123/426, 630, 644, 417, 198 DC, 425; 73/118.1, 118.3, 117.3, 116, 119 A; 340/945, 973

[56] References Cited

U.S. PATENT DOCUMENTS

| | | | |
|---|---|---|---|
| Re. 28,904 | 7/1976 | Maisonville | 324/392 |
| 3,886,450 | 5/1975 | Trussell et al. | 324/170 |
| 3,965,669 | 6/1976 | Larson et al. | 368/9 |
| 4,135,246 | 1/1979 | McMannis | 364/431.02 |
| 4,192,179 | 3/1980 | Yelke | 73/119 A |
| 4,207,611 | 6/1980 | Gordon | 364/424.03 |
| 4,296,409 | 10/1981 | Whitaker et al. | 364/424.03 |
| 4,304,126 | 12/1981 | Yelke | 73/119 A |
| 4,319,481 | 3/1982 | Yelke | 73/119 A |
| 4,404,641 | 9/1983 | Bazarnik | 364/424.03 |
| 4,437,538 | 3/1984 | Wilson | 324/642 |
| 4,551,803 | 11/1985 | Hosaka et al. | 364/431.05 |
| 4,559,637 | 12/1985 | Weber | 364/431.12 |
| 4,575,809 | 3/1986 | Sinniger et al. | 364/569 |
| 4,578,755 | 3/1986 | Quinn et al. | 364/431.01 |
| 4,644,284 | 2/1987 | Friedline et al. | 364/431.12 |
| 4,677,847 | 7/1987 | Sanatari et al. | 73/117.3 |
| 4,812,768 | 3/1989 | Quinn | 364/551.01 |
| 4,812,979 | 3/1989 | Hermann et al. | 364/431.01 |
| 4,821,216 | 4/1989 | Howell et al. | 364/551.01 |
| 4,831,536 | 5/1989 | Yakuwa et al. | 364/431.03 |
| 4,831,560 | 5/1989 | Zaleski | 364/551.01 |
| 4,853,859 | 8/1989 | Morita et al. | 364/424.03 |
| 4,975,846 | 12/1990 | Abe et al. | 364/424.03 |
| 5,001,431 | 3/1991 | Garasimowicz et al. | 324/393 |
| 5,003,478 | 3/1991 | Kobayashi et al. | 364/424.03 |
| 5,004,984 | 4/1991 | Becker et al. | 324/402 |
| 5,043,659 | 8/1991 | Lonmiller et al. | 324/160 |
| 5,050,080 | 9/1991 | Abe | 364/424.04 |
| 5,151,654 | 9/1992 | Krzywicki et al. | 324/160 |
| 5,160,892 | 11/1992 | Makhija et al. | 364/431.03 |
| 5,198,980 | 3/1993 | Patrick | 364/424.03 |
| 5,208,541 | 5/1993 | Yerkovich et al. | 324/402 |
| 5,214,582 | 5/1993 | Gray | 364/424.03 |
| 5,222,469 | 6/1993 | Sutton | 123/198 DC |
| 5,257,190 | 10/1993 | Crane | 364/424.03 |
| 5,307,017 | 4/1994 | Mamyoma et al. | 324/402 |
| 5,317,267 | 5/1994 | Miyata et al. | 324/393 |
| 5,337,003 | 8/1994 | Carmichael et al. | 324/402 |
| 5,397,860 | 3/1995 | Yochum et al. | 174/113 C |

*Primary Examiner*—Kevin Teska
*Assistant Examiner*—Jacques Louis-Jacques
*Attorney, Agent, or Firm*—Cumpston & Shaw

[57] ABSTRACT

An engine monitor includes, in a self-contained preferably sealed unit, a spark sensor, inductively and capacitively coupled through the case to a spark pick up wire, a timer, and a running time detector, responsive to inputs from the spark pick up to provide total running time, job time, and service time metering. Preferably, storage means are included for storing maximum RPM and spark mode data, that is, data indicating the number of firings per RPM for the particular engine, as well as a preset service interval and one or more auxiliary timers.

28 Claims, 17 Drawing Sheets

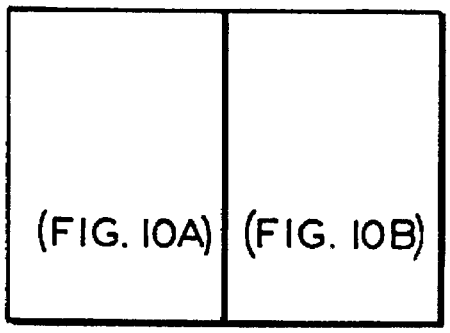
FIG. 10
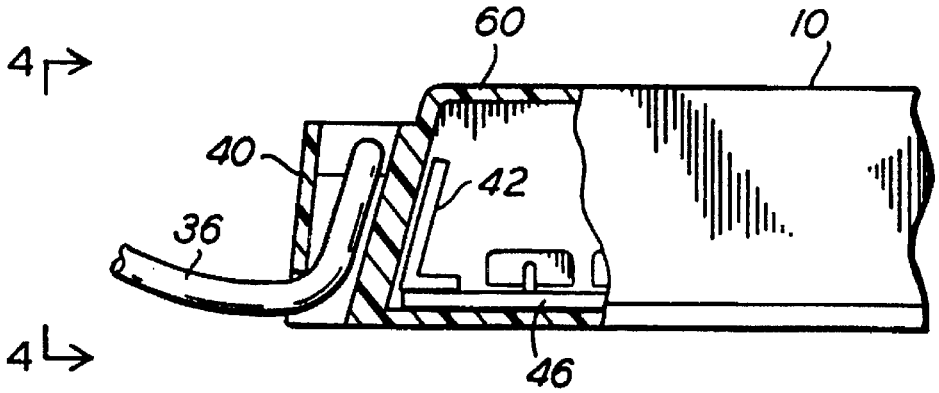
FIG. 3
FIG. 4
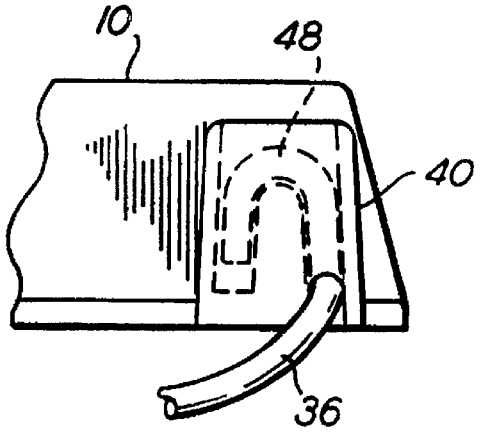

SELF CONTAINED MULTI-FUNCTION ENGINE MONITOR AND TIMER FOR PROVIDING ENGINE RUNNING TIME, JOB TIME, SERVICE TIME AND TACHOMETER FUNCTIONS

FIELD OF THE INVENTION

This invention relates generally to an engine monitor, and more particularly to a self-contained multi-function engine monitor and timer that provides engine running time, job time, service time, and tachometer functions.

DESCRIPTION OF THE PRIOR ART

Sophisticated engine monitoring systems are increasingly commonly employed, not only in large expensive vehicles such as airplanes, but more and more in ordinary passenger vehicles, such as cars and trucks. U.S. Pat. No. 5,257,190 describes an engine management system for powered vehicles that senses a large number of parameters of the engine powered vehicle and performs real time management for identifying system inefficiencies and sub-systems requiring repair. The device includes a microprocessor and an analogue to digital converter connected between a plurality of inputs and the microprocessor to convert the analogue output of input sensors into digital output for the microprocessor. A large number of direct real time inputs is described including RPM and the system includes a clock for implementing timing functions.

U.S. Pat. No. 4,853,859 shows a device for detecting operating conditions of a vehicle. The apparatus measures RPM and includes a clock for discriminating the entire working time of an engine into engine idling, operation of the vehicle and rest time.

U.S. Pat. No. 4,551,803 describes an engine monitoring system having a multiplicity of inputs and a clock for monitoring a number of engine parameters to perform various functions including speed metering, odometer, trip meter, tachometer, and the like.

BACKGROUND OF THE INVENTION

While known devices satisfy, to a greater or lesser extent, the need for monitoring of engine parameters and operating time, they do so in systems that are closely integrated with the engine itself, and which, even when cost effective from a price performance standpoint, add considerable cost to the overall system.

There is a need for a low cost, after-market engine monitor to provide certain basic functions, such as RPM and timing functions. There is a large number of engine driven vehicles and apparatus in existence that have no built in monitoring functions. When these devices are routinely operated by a number of different people, especially in a rental environment, it is difficult to accurately monitor the operation of the engine so that preventive maintenance can be performed in a timely manner. In addition, especially in a rental environment, it is desirable to provide a means for monitoring the running time of an engine, so as to more fairly apportion rental charges based on running time, instead of time of possession. Still further, it is desirable to monitor maximum engine RPM to determine whether an engine has been operated beyond its safe operating range, redline.

An engine monitor that provides all of these characteristics is even more useful if it is small, self-contained, and easily fitted to an existing engine on an existing piece of equipment in a manner that can provide the foregoing functions in a cost effective, low maintenance, easy to install unit.

SUMMARY OF THE INVENTION

These and other objects are provided by an engine monitor in accordance with the present invention that includes, in a self-contained preferably sealed unit, a spark sensor, inductively and capacitively coupled through the case to a spark pick up wire, a timer, and a running time detector, responsive to inputs from the spark pick up to provide total running time, job time, and service time metering. Preferably, storage means are included for storing maximum RPM and spark mode data, that is, data indicating the number of firings per RPM for the particular engine, as well as a preset service interval and one or more auxiliary timers.

The engine monitor of this invention is adapted to be controlled by a user through the activation of a single push button. The various functions of the engine monitor are selected and displayed on the built-in display by activating the push button in different sequences for different times to enter the various functions.

BRIEF DESCRIPTION OF THE DRAWING

FIG. 3 is a side elevation, partly in section, of the engine monitor of this invention showing the spark plug input tab within the housing of the engine monitor.

FIG. 4 is a side elevation view of the spark plug wire mounting bracket.

FIGS. 11–17 are flow chart diagrams showing the manner in which the software running on micro-controller 50 controls the operation of the engine monitor wherein

DESCRIPTION OF THE PREFERRED EMBODIMENT

Figure 1:
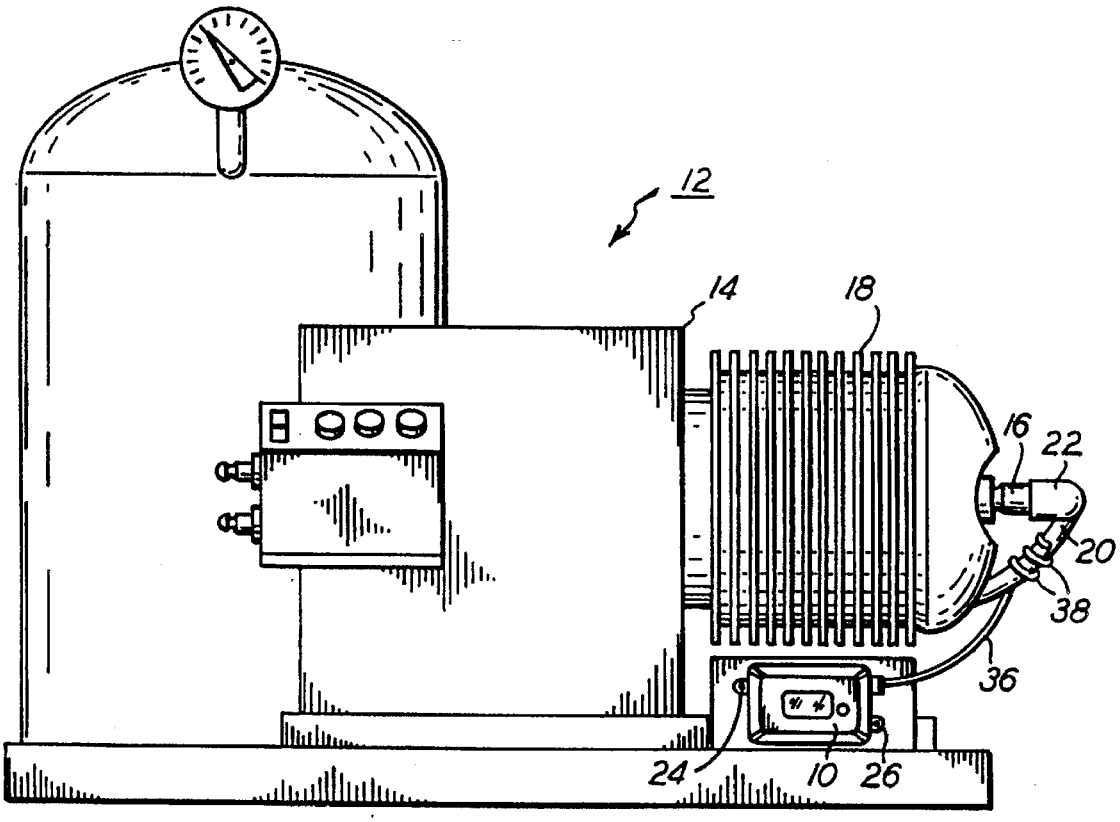
FIG. 1 is a front elevation of an air compressor powered by an internal combustion engine showing the mounting of an engine monitor in accordance with this invention on the support for the compressor.
Figure 2:
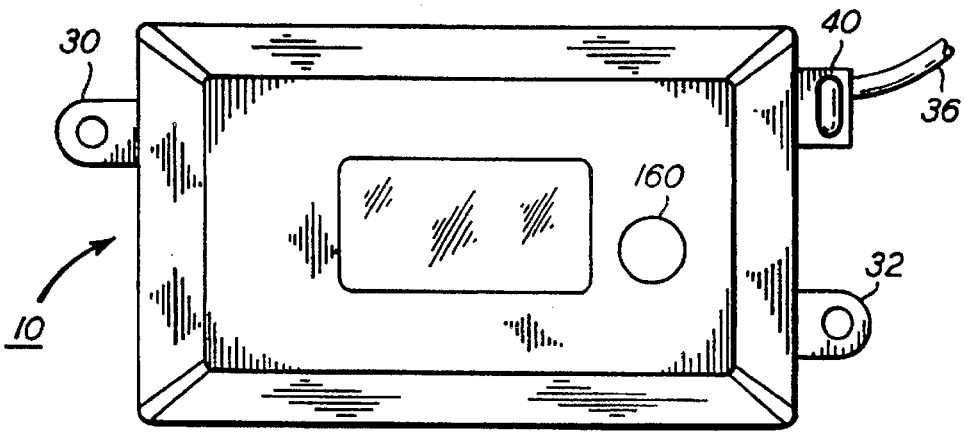
FIG. 2 is a top plan view of the engine monitor of this invention.

FIG. 1 shows an engine monitor 10 in accordance with this invention installed on a portable air compressor 12. The compressor is powered by a conventional internal combustion engine 14 having a spark plug 16 disposed in a cylinder 18 for driving the compressor. The spark plug 16 is connected to a conventional spark coil or magneto, not shown, by a spark plug wire 20 leading to a removable cap 22 that engages the spark plug 16. The engine monitor 10, shown in an enlarged view at FIG. 2, is mechanically attached to the compressor by conventional fasteners 24, 26 such as bolts, extending through two mounting lugs 30, 32 integrally formed with the case of the engine monitor 10. A spark plug pick up wire, or antenna wire 36 has one end having several turns 38 wrapped around the spark plug wire 20 and another end mechanically fastened to a clamp 40 on the outside of the engine monitor case and inductively and capacitively coupled to a spark pick up terminal within the case. In a non-secure or temporary installation, the pick up wire 36 may be secured to the spark plug wire in any conventional fashion such as through the use of tape or a clamp or the like. In a secure installation where the engine monitor 10 is used to measure operating time for billing purposes or the like, the spark pick up wire 36 is preferably secured to the spark plug wire 20 with a tamper evident attachment.

FIGS. 3 and 4 show the manner in which the spark pick-up wire 36 is inductively and capacitively coupled to the circuit of the engine monitor. Preferably, the engine monitor includes a clamp for securing an end of the spark plug pick-up wire adjacent to a tab 42 electrically connected to a trace on a printed circuit wiring board 46 disposed within the housing of the engine monitor of this invention. The circuitry of the engine monitor will be described in more detail below. Preferably, the clamp 40 forms the end of the wire into an inverted U-shape as shown in FIG. 4.

Figure 5:
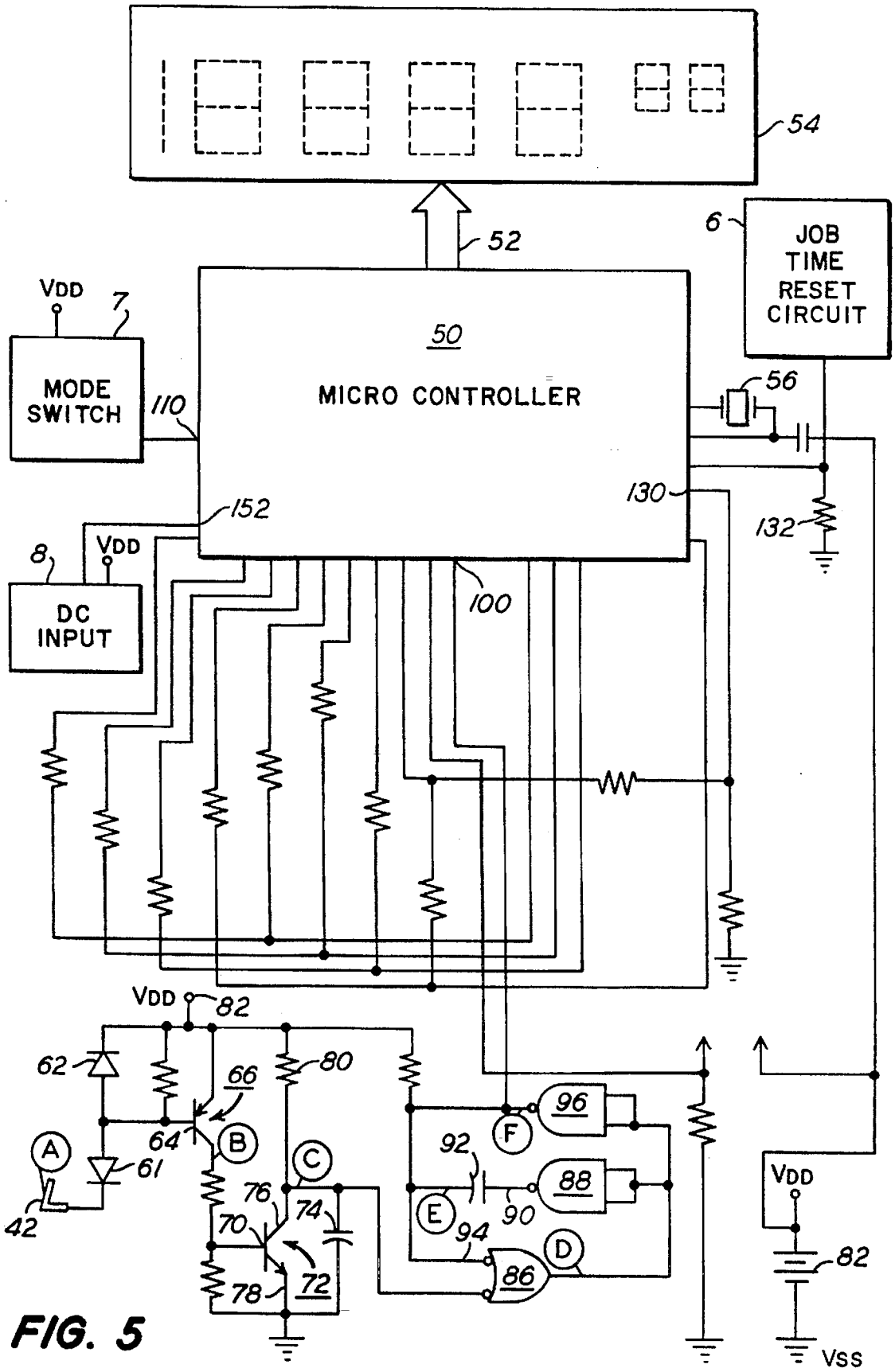
FIG. 5 is a schematic diagram of the engine monitor of this invention.
Figure 6:
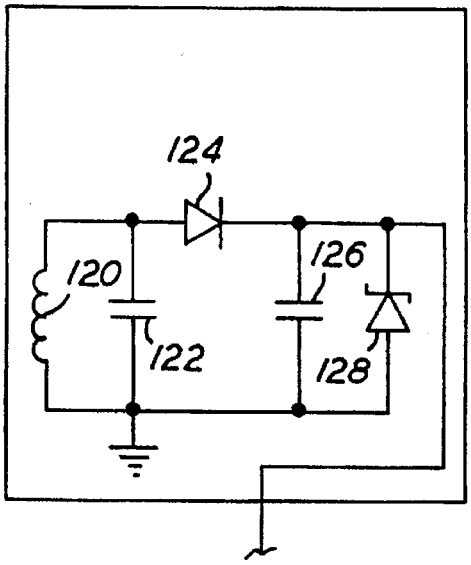
FIG. 6 is a schematic diagram of the job time reset circuit of the invention.
Figure 7:
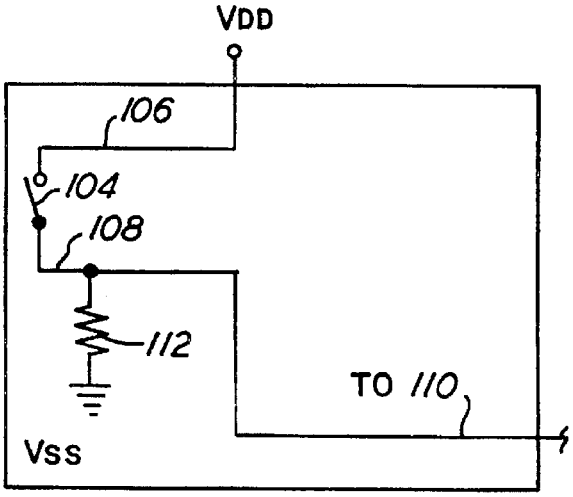
FIG. 7 is a schematic diagram of the mode switch of the invention.
Figure 8:
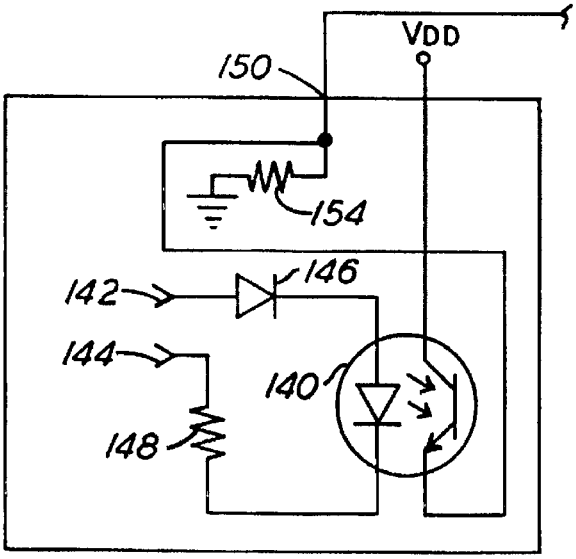
FIG. 8 is a schematic of the DC input of the invention.
Figure 9:
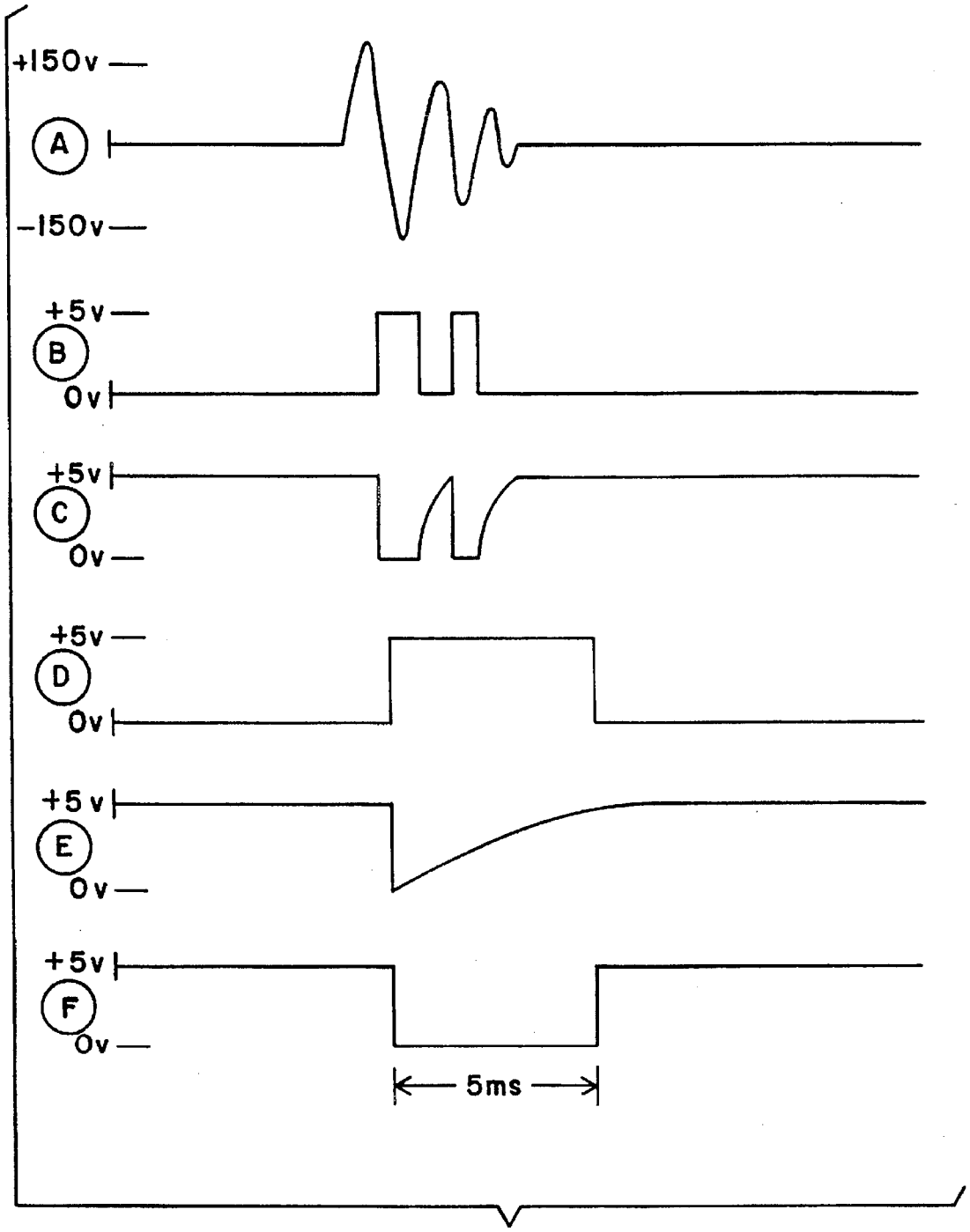
FIG. 9 are wave form diagrams corresponding to the nodes labeled A–F in FIG. 5.

FIG. 5 is a schematic diagram showing the overall arrangement of an engine monitor in accordance with this invention, and FIGS. 6–8 show components for implementing the optional job guard, mode switch, and non-spark engine functions of the engine monitor.

Referring now to FIG. 5, the engine monitor 10 includes a conventional general purpose microcomputer such as a MC 68HC05L5 microcomputer manufactured by Motorola. The microcomputer includes read only memory for storing the computer software program that controls the operation of the monitor, read/write memory for use in executing the program, and for storing temporary values, such as the job time, service time, maximum RPM and the like, as will be described in more detail later, a central processing unit, an LCD display driver, and conventional ancillary circuits, such as a clock for providing timing signals to the microprocessor, and for implementing the total time, job time, and service time functions of the engine monitor. The micro controller 50 has a plurality of input and output terminals, including a multi conductor connection 52 to a four and one-half digit LCD display 54, oscillator terminals for connection to a frequency determining component, such as a quartz crystal 56, a plurality of I/O terminals, a reset terminal, an interrupt terminal, all of which, together with others, will be described in more detail below.

It is a particular advantage of the engine monitor of this invention that no direct connection to the spark plug wire of the engine on which the monitor is installed is required. Preferably the electrical components of the engine monitor are attached to a printed circuit wiring board 46, which is encapsulated in epoxy or the like to both physically secure the components to the board to improve reliability in the sometimes hostile environments in which the engine monitor may operate, and to seal the components and protect them from the environment. The engine monitor is preferably enclosed within a plastic case 60, more preferably a case without any through wires or holes, so that the engine monitor as a whole is at least water resistant.

The engine monitor 10 receives input signals from the spark plug pick up wire 36 inductively and capacitively through the plastic case 60. A metal tab 42 which may be about one-quarter inch square is physically positioned adjacent to an unshielded portion of the inside wall of the case in close proximity to a pick up wire clamp 40 attached to the outside of the case. Preferably the end of the spark plug pick up wire 36 is formed into a small loop 48 arranged parallel to the tab 42 for inductively and capacitively coupling a signal derived from the spark plug wire 36 to the tab 42 for processing within the engine monitor 10. The tab 42 within the engine monitor is connected to a rectifier including two diodes 61, 62 for rectifying the spark signal received by the tab 42 and applying it to the base 64 of a transistor 66 connected in a common collector amplifier configuration. The output of this amplifier is connected to the base 70 of a second transistor 72 arranged as a pulse differentiator. The transistor 72 has a capacitor 74 connected between its collector 76 and emitter 78, and a resistor 80 connected from the collector to a positive voltage supply such as a 3 v battery 82.

The output of the differentiator is connected to an OR-gate 86 that functions to remove the effects of ringing to produce a clean pulse for each spark. The clean output of the OR-gate 86 is connected to a NAND-gate 88 arranged as an inverter having its output 90 connected to a capacitor 92 for differentiating the pulse. The differentiated pulse is connected to a second input 94 of the OR-gate. The shaped output of the OR-gate 86 is connected to a NAND-gate 96 arranged as an inverter for providing one negative going pulse per spark to an interrupt input 100 of the micro controller 50.

FIGS. 9A–9F show the wave forms appearing at the like labeled points A–F in FIG. 5. The pulse as applied to the interrupt input 100 of the micro controller allows the controller 50 to determine the RPM of the engine to which the monitor is attached, and also to control the total running time, job time, and service lime clocks, by enabling the clocks when the engine is running as shown by the presence of pulses at the interrupt input.

FIG. 7 which corresponds to Box 7 of FIG. 5, shows the components that are optionally provided for implementing the mode switch function of the invention. A single pole single throw momentary contact normally open switch 104 has one terminal 106 connected to a power supply $V_{DD}$, its other terminal 108 connected to an input terminal 110 of the micro controller 50, and a high value resistor 112 connected to the negative battery terminal $V_{SS}$ of the engine monitor. The mode switch provides a signal that can be sampled by the micro controller on a regular basis to determine when the switch is pressed. When the engine monitor is provided in a run time only mode, without any other functions, the switch 104 may be omitted.

FIG. 6 and Box 6 show the components for implementing the job time reset function of the invention, as will be described in more detail later. The job time reset functional allows an external controller that includes an electromagnetic oscillator, for example, to be brought into proximity with the engine monitor for resetting the job time. A tuned circuit including an inductor 120 and a capacitor 122 is responsive to a signal produced by the electromagnetic oscillator. A detector including a diode 124 and a capacitor 126 are connected to the circuit and a zener diode 128 limits the voltage produced by the circuit before applying it to an input 130 of the micro controller. In this way a signal is produced when the external oscillator is brought into close proximity with the engine monitor. A pull down resistor 132 keeps input 130 low unless a reset signal is present.

Mother optional function is to provide a running time indication whenever a DC voltage is applied to the engine monitor. This is useful in non-spark plug engines such as diesel engines. The components for implementing this function are shown in FIG. 8, which corresponds to Box 8 of FIG. 3. A conventional opto-coupler 140 is connected to a pair of input terminals 142, 144 through a diode 146 and a resistor 148 for protecting against an inadvertent reverse polarity connection and limiting the current through the opto-coupler. The output 150 of the opto-coupler is connected to an input 152 of the micro controller 50 where its signal is sensed by software in a manner analogous to the signal produced by the spark plug conditioning circuit to indicate that the engine is running. A pull down resistor 154 keeps output 150 low except when a DC signal is applied to terminal 142, 144.

Figure 10A:
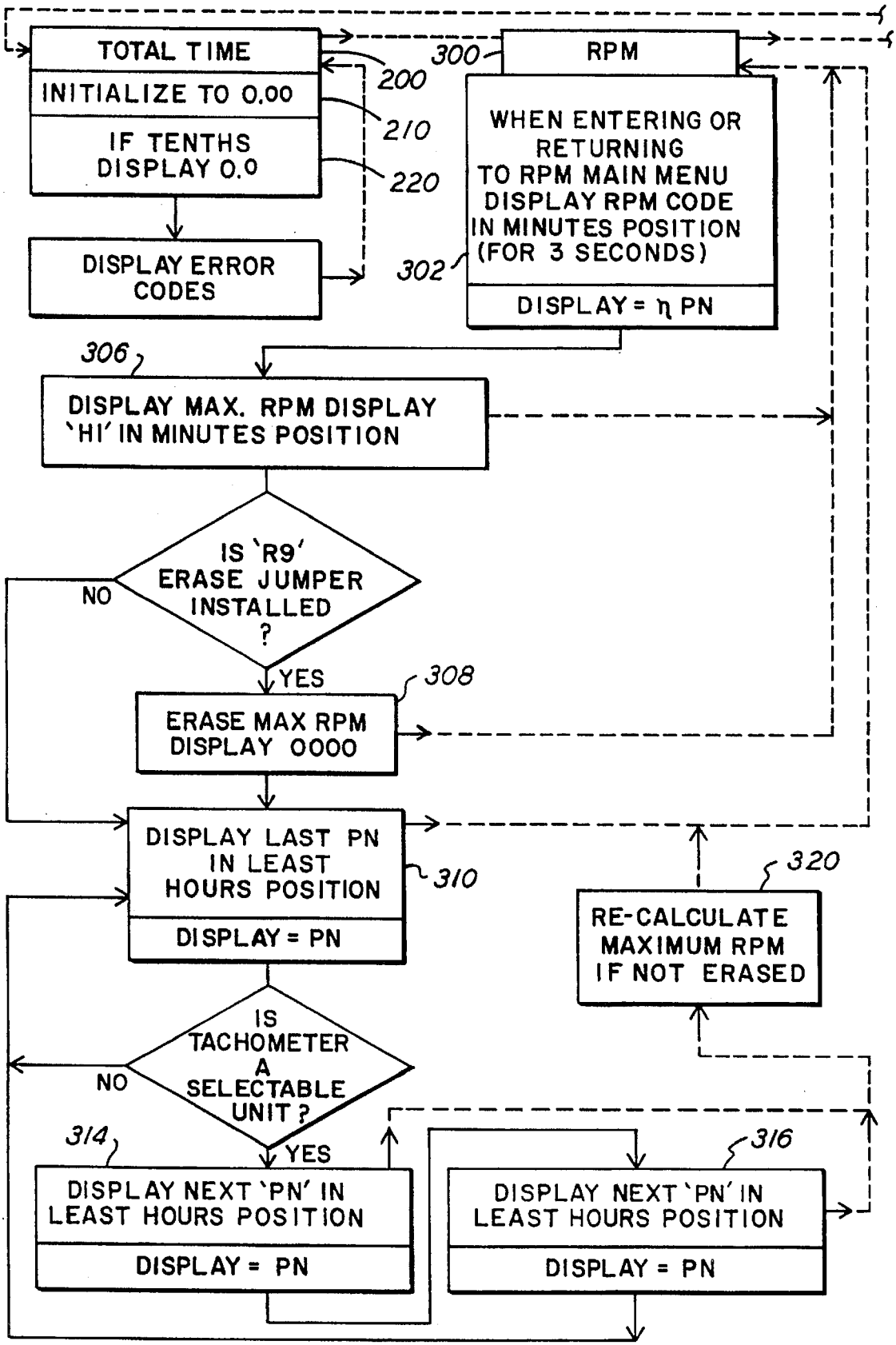
FIGS. 10A and 10B is a flow chart diagram showing the way in which the push button selects the various functions, controls the display, and switches operating modes of the engine monitor.
Figure 10B:
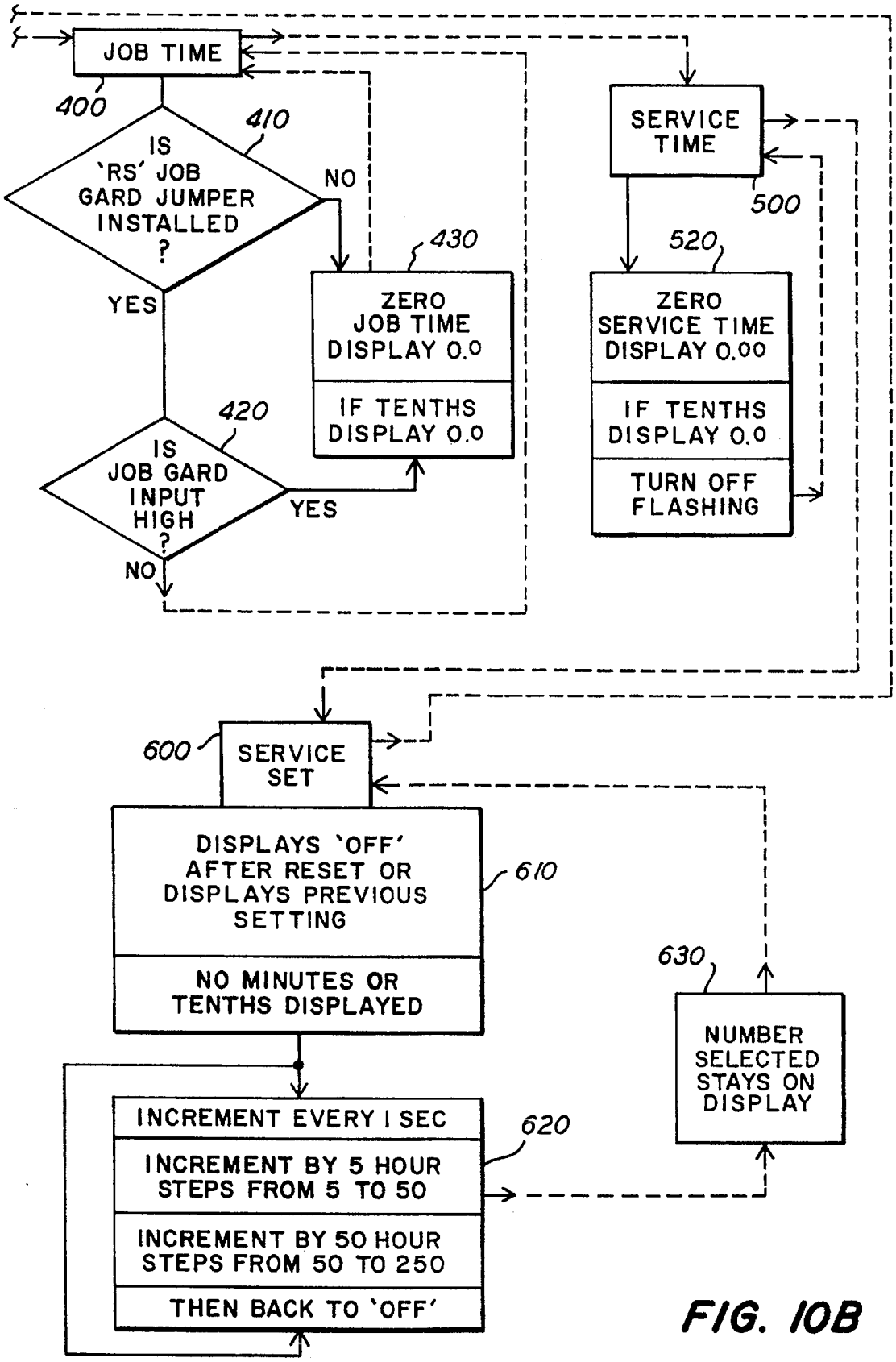

The flow chart in FIG. 10 shows all of the available functions of the engine monitor. The engine monitor may be supplied to a user with all functions enabled, or with only a sub-set of functions enabled.

Referring to FIG. 10, the functions, total time 200, RPM 300, job time 400, service time 500, and service set 600 are shown. The engine monitor itself continuously loops through these functions without the need for user intervention. By stepping through the functions by pressing a button 160, the user can select which function is displayed and configure the engine monitor modes within each function.

The total time mode 200 has no user configurable options. The total time is initialized to zero 210 during the manufacture of the engine monitor, and is operable continuously whenever the engine monitor is connected to an engine that is running. As will be described in more detail below, the total time accumulates whenever either a signal from the spark sensor is detected by the engine monitor, or a DC signal indicating that power is being provided to a non-spark engine is sensed. There are two factory selectable display modes for total time; hours and minutes, and hours and tenths of hours. One of the display modes is selected 220 when the engine monitor is manufactured according to the wishes of the purchaser. The same display mode also applies to the job time and service time modes, as will be described later.

Optionally, total time function may include an error code display function that is designed not to be inadvertently accessed by the user. If the button 160 is pressed and held for more than 10 seconds, the display of the engine monitor shows a code indicating either normal operation or one or more preselected error conditions. This allows malfunctions of the engine monitor to be diagnosed either when the monitor is returned to the factory, or in an appropriate circumstance remotely by instructing a user as to entering the error mode.

The user switches between the main modes: total time, RPM, job time, service time and service set by pressing and releasing the button in less than three seconds. Repeated short button pushes therefore cycle through the main modes.

A plurality of sub-modes are selected from the main mode by pressing and holding the button for periods greater than 3 seconds, as will now be described in more detail. When the RPM mode is entered, the RPM code is displayed in the minutes position for three seconds 302. The RPM code indicates the ratio of sparks to RPM currently selected. Three RPM modes are provided, P1 in which one spark equals one RPM, P2 in which 2 sparks equal 1 RPM, and P3 in which one spark equals 2 RPM. The RPM mode can be selected manually by the user or can be permanently configured by internal jumpers, as will be described later. After 3 seconds, the display shows the current RPM of the engine in the four and one-half digit hours portion of the display.

The engine monitor includes a memory in the micro controller for storing the maximum RPM detected by the monitor since the maximum RPM function was reset. The maximum RPM display mode is selected from the RPM mode by pressing and holding the button for more than three seconds. In the maximum RPM mode, 306 the display shows the maximum RPM up to 19,999 in the hours position of the display and displays the letters HI in the minutes position for up to 6 seconds. If the button is released while the maximum RPM is displayed, the monitor reverts to the RPM mode. button is released while the maximum RPM is displayed, the monitor reverts to the RPM mode.

From the maximum RPM display mode, if the button is held for more than six seconds, the maximum RPM reset mode 308 is entered if enabled by the presence of an internal jumper R9. If the jumper is present, the memory storing the maximum RPM is erased, and the display is set to 0000. If the button is released from this mode, the monitor reverts to the RPM mode 300. If the maximum RPM reset mode 308 is not enabled or if the button is held more than three seconds after the maximum RPM has been reset, the monitor enters the tachometer set mode 310. When this mode is first entered, the display shows the current tachometer mode in the least hours position. If the button is held for one more second and the unit is configured as a user selectable tachometer mode monitor, the display shifts to the next tachometer mode, 314 and after one more second to the third mode 316. As long as the button is held, the unit cycles among the three tachometer modes continuously. The user selects the desired mode by releasing the button while the unit is in the desired mode and the display shows the code for the desired mode. If the user selects a mode different from the current mode, the maximum RPM is recalculated 320 if it has not been erased. Preferably the maximum RPM is not displayed at the time of recalculation, but stored directly in memory for display in the maximum RPM mode as already described. Once a new tachometer mode is selected or the current mode is left undisturbed, operation reverts to the normal RPM mode.

From the RPM mode by pressing and releasing the button in less than three seconds, the job time mode 400 is entered. The job time mode displays elapsed ruing time since the last time the job time was reset. Two options are available for resetting job time. If a job guard jumper is enabled at the factory, a job guard signal must be provided to reset the job time. If the engine monitor is not configured in a job guard configuration, the user may reset the job time by button presses alone.

When in the job time mode, if the button is held for more than three seconds, the monitor senses whether the job guard jumper 410 is installed. If not, the job time is set to 0 430. When the button is released the monitor reverts to the job time mode. If a jumper is installed to configure the monitor in a job guard configuration, when the button is held for more than three seconds the monitor determines whether a job guard input is present 420 If it is, the job time is reset 430 to 0, as in the mode just discussed. If no job guard input is present, the monitor simply reverts to the job time mode 400 and job time continues to accumulate as long as the engine is running.

From the job time mode 400, the service time mode 500 is entered by pressing and releasing the button within three seconds. The service time mode is provided to enable the monitor to remind a user of the need for periodic service, based on running time of the engine. The service time mode timer is reset from the service time mode by holding the button for more than three seconds. After three seconds, the service time display is zeroed 520, and when the button is released, the monitor reverts to the service time mode.

From the service time mode the user may set the service time interval in the service set mode 600. The user enters the service set mode by pressing and releasing the button within three seconds. When the service interval is 0, the display shows "OFF", and the service time mode is simply another timer with no alarm function. The service timer accumulates time while the engine is running in substantially the same way as the job time timer.

If the service interval is set to a value other than 0, the service alarm is enabled when the time accumulated in the service timer exceeds the preselected service interval, a service alarm is activated. This alarm is indicated by flashing the display, preferably at a one half second on, one haft second off rate in all modes of operation, the Total time mode, the RPM mode, The Service Time mode, and the Service Set mode.

When the service set mode 600 is entered 610, the display shows the current service time interval or "OFF". The service time interval is set from the service set mode by pressing and holding the button for more than three seconds. While the button is pressed, the service interval is incremented, preferably each second, in preselected increments. Preferably, the service interval is incremented in five hour steps from five to fifty hours, and then in fifty hour steps from fifty to two hundred and fifty hours, and then back to "OFF". The service interval is selected by releasing the button when the desired interval is displayed. In this way, the service interval can be selected as desired by the user or turned "OFF". The selected interval is displayed 630 and the monitor reverts to the service set mode. The monitor can be returned to the total time mode by pressing and releasing the button in less than three seconds. Alternatively, the user can change the service time interval by pressing and holding the button for more than three seconds, and proceeding as just described.

FIGS. 11–17 are flow charts showing the operation of the software running in microprocessor 50.

Figure 11:
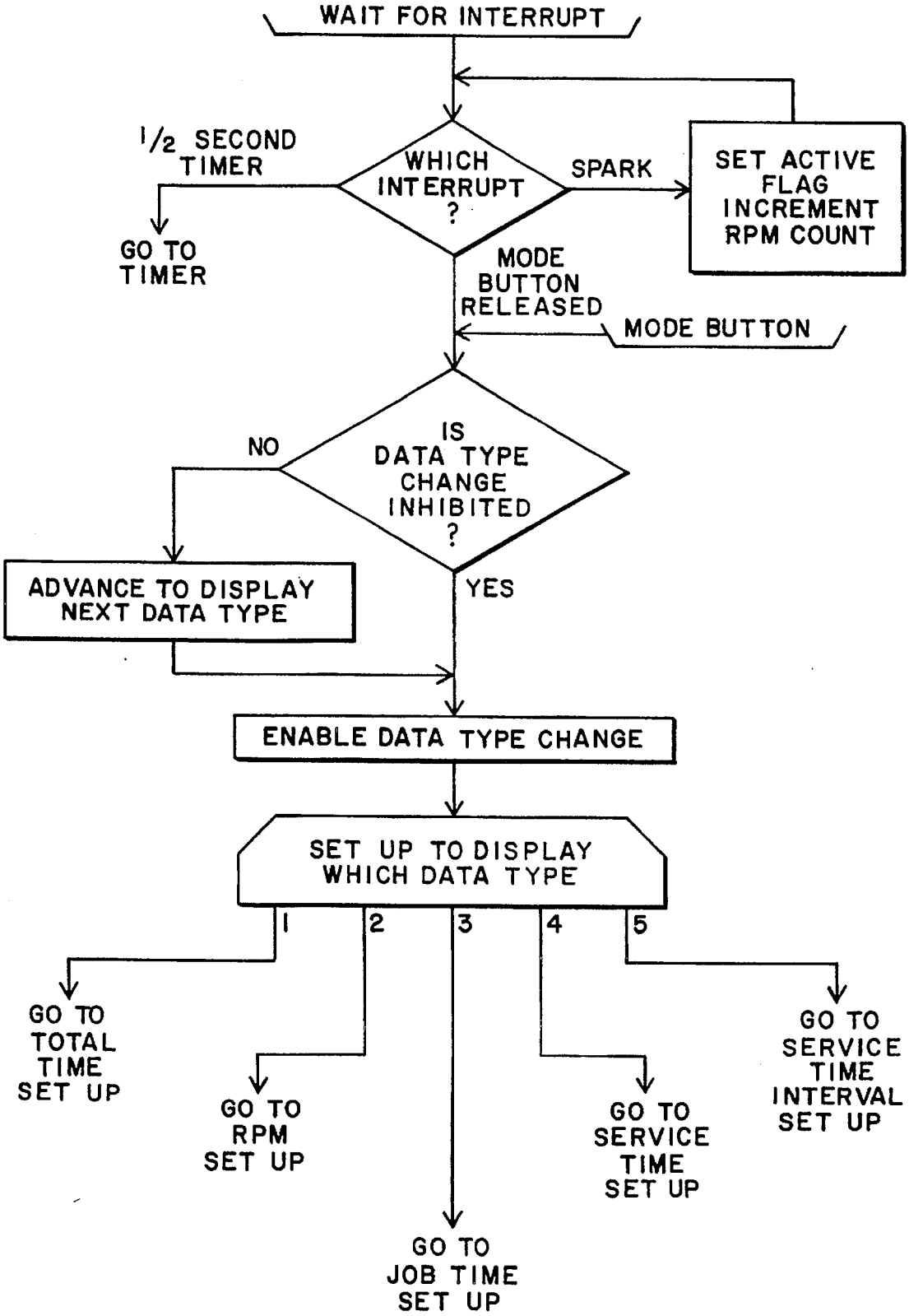

The software is interrupt driven. Each time an interrupt occurs, as shown in FIG. 11, the source of the interrupt is determined and the program flow is directed accordingly. The internal clock generates an interrupt every half second, and upon receiving that interrupt flow is directed to the timer routine as shown in FIG. 12.

A spark signal applied to interrupt pin 100 as shown on FIG. 5 sets the active flag, which starts the total time clock and other clocks as will be described later, and increments the RPM count.

Releasing the mode button checks the data type change inhibited flag. If data type change was inhibited, it is enabled. If data type change is not inhibited, the display advances to the next data type. A switch directs flow to the selected main function, i.e., total time set-up, RPM set-up, job time set-up, service time set-up or service time interval set-up.

Figure 12A:
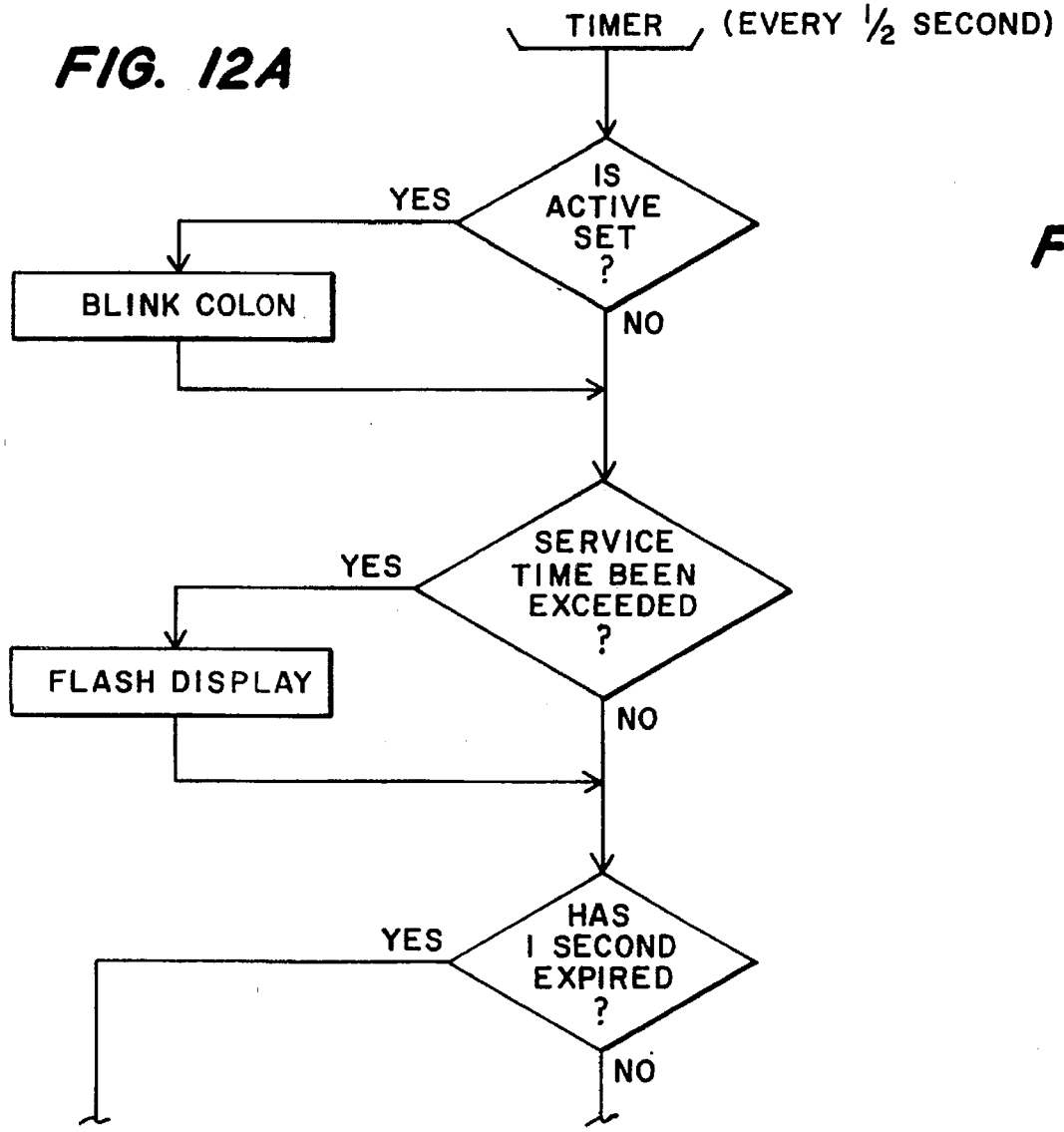
FIGS. 12A and 12B are flow charts showing the relationship of the timer display and associated functions and FIGS. 14A, 14B and 14C are flow charts showing the monitoring of RPM data in relationship to timer modes.
Figure 12:
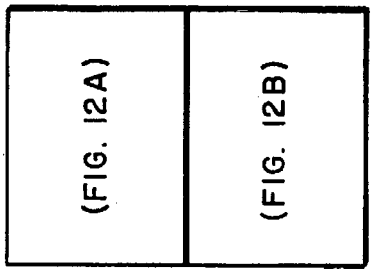
Figure 14:
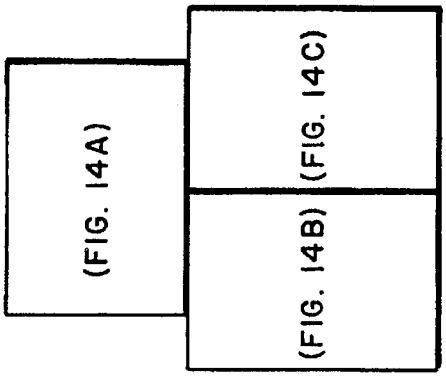
Figure 12B:
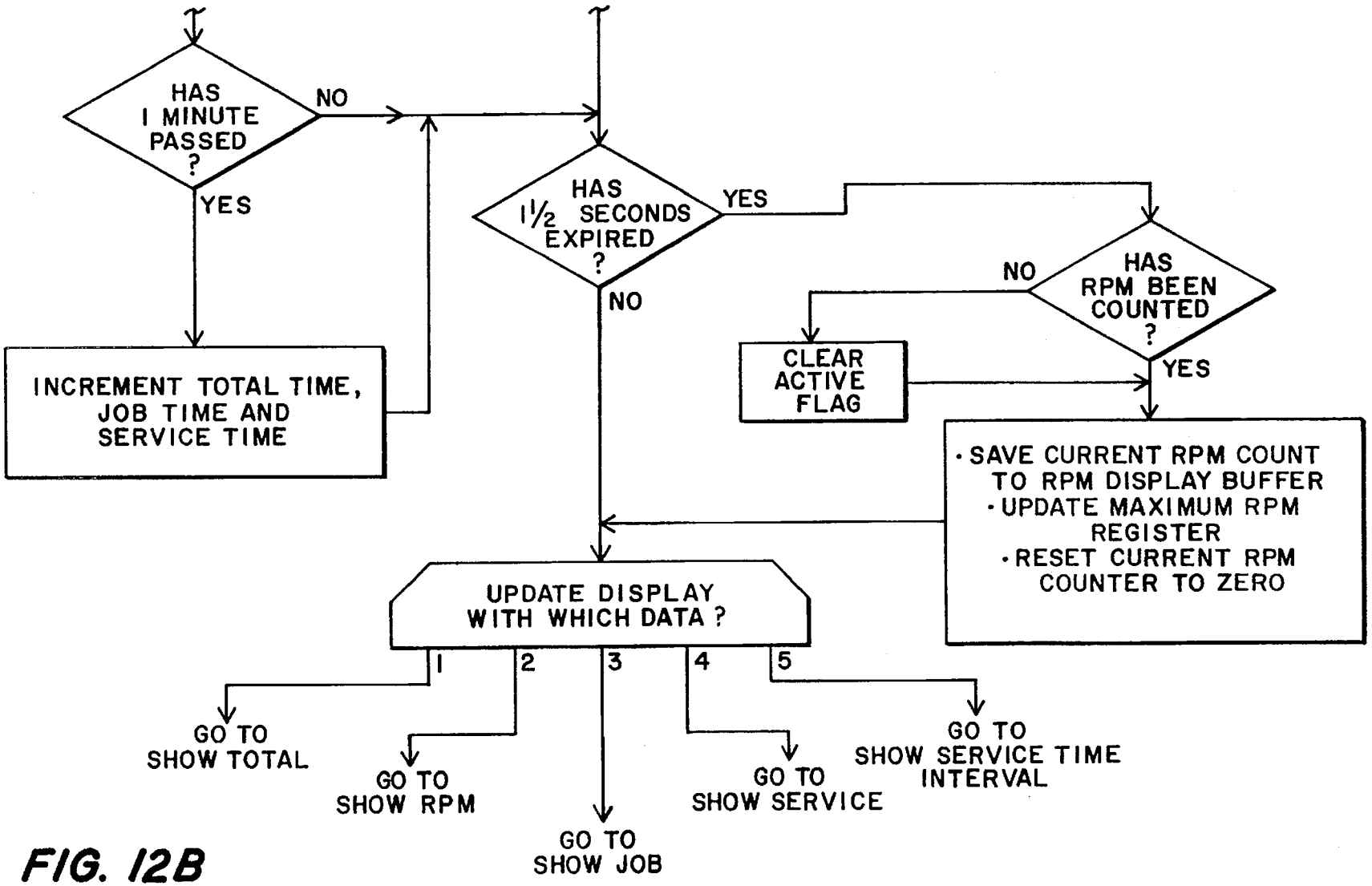

FIG. 12 shows the timer routine. On entry, if the active flag is set (see FIG. 11), the software blinks the colon to show that the clock is running. If the service time is exceeded, the software flashes the display. If one second has expired, the routine determines whether a minute has passed, and if so, the total time, job time, and service time registers are incremented by a minute. If one and one-half seconds have elapsed, the software determines whether the RPM has been counted. If not, the active flag is cleared to turn off the timers. If the RPM has been counted, the cuttent RPM count is saved to the RPM display buffer, the maximum RPM register is updated as necessary, and the current RPM counter is reset to 0. The software then branches to update the currently active display, that is the total, RPM, job, service, or service time interval displays.

Figure 13:
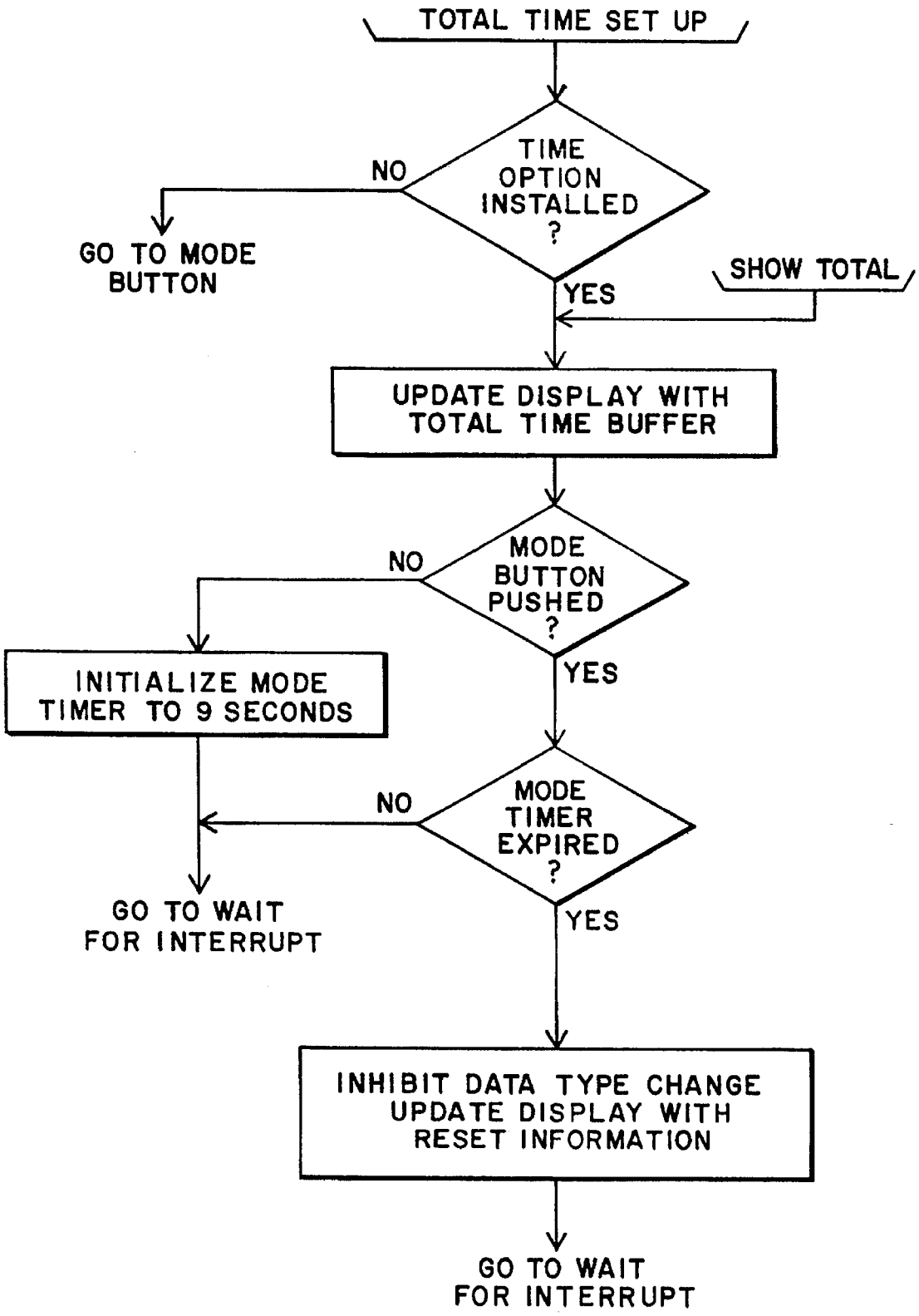

FIG. 13 shows the total time set-up routine. There are two entry points, total time set-up and show total coming from FIGS. 11 and 12 respectively. If the time option is not installed, that is if the meter is an RPM only meter, control branches to the mode button entry point, as discussed in FIG. 11. Otherwise, the display is updated from the total time buffer.

The state of the mode button is then detected. If the mode button is not pushed, the mode timer is initialized to 9 seconds, and flow returns to the wait for interrupt routine. If the mode button is pushed, the mode timer is checked and if it has expired, data type change is inhibited and the display is updated with reset information. Flow then returns to the wait for interrupt routine.

Figure 14A:
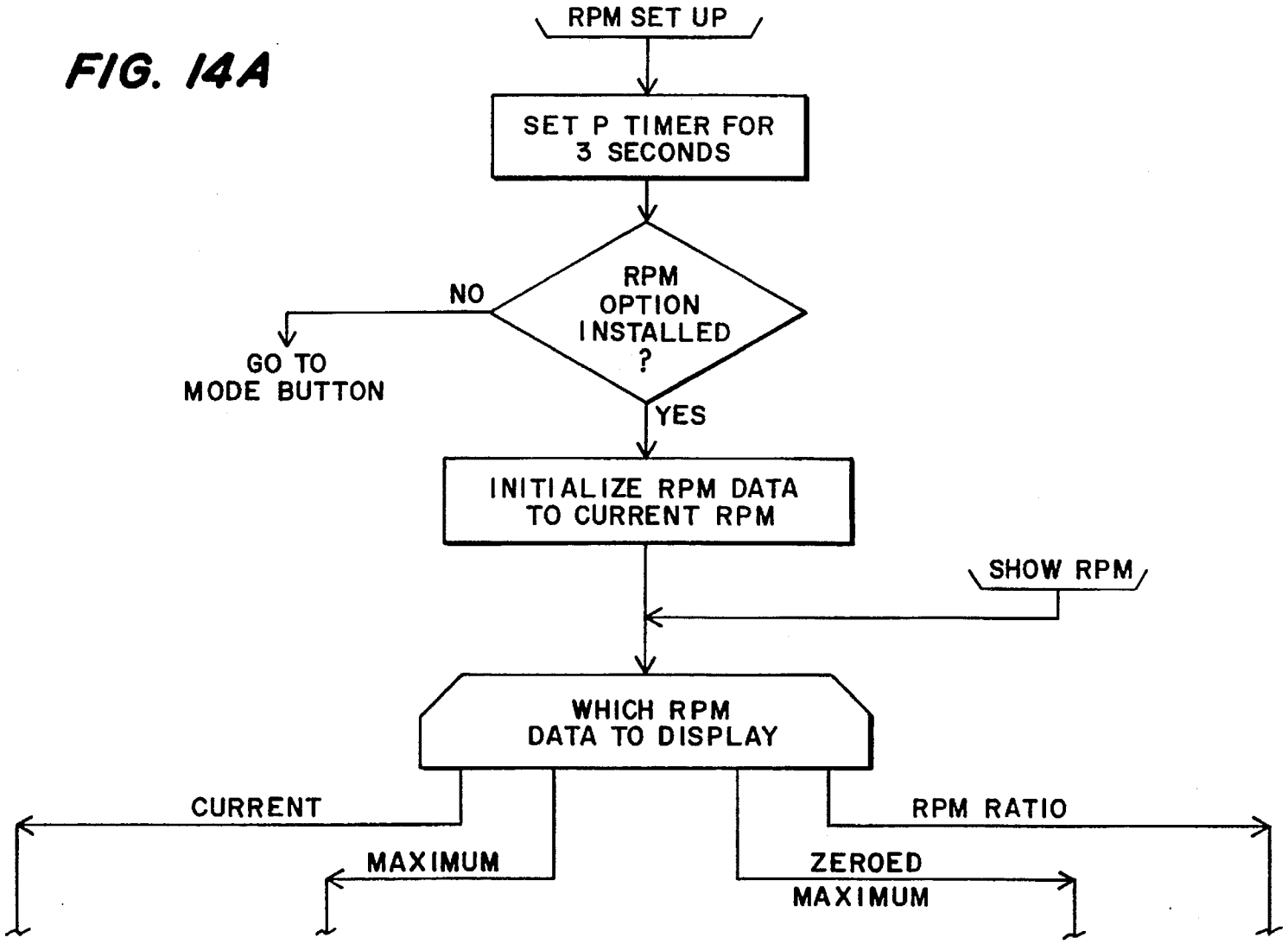
Figure 14B:
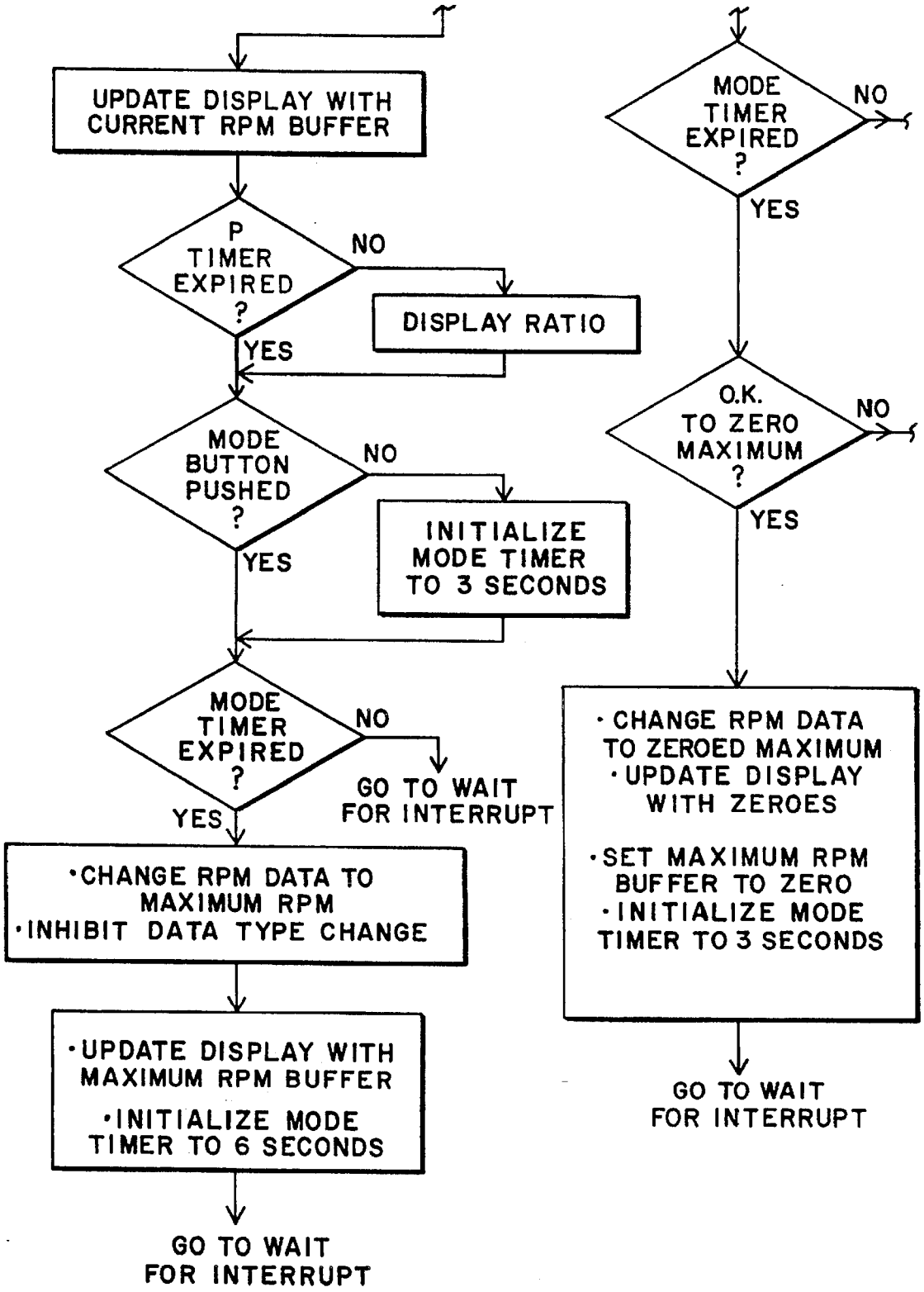
Figure 14C:
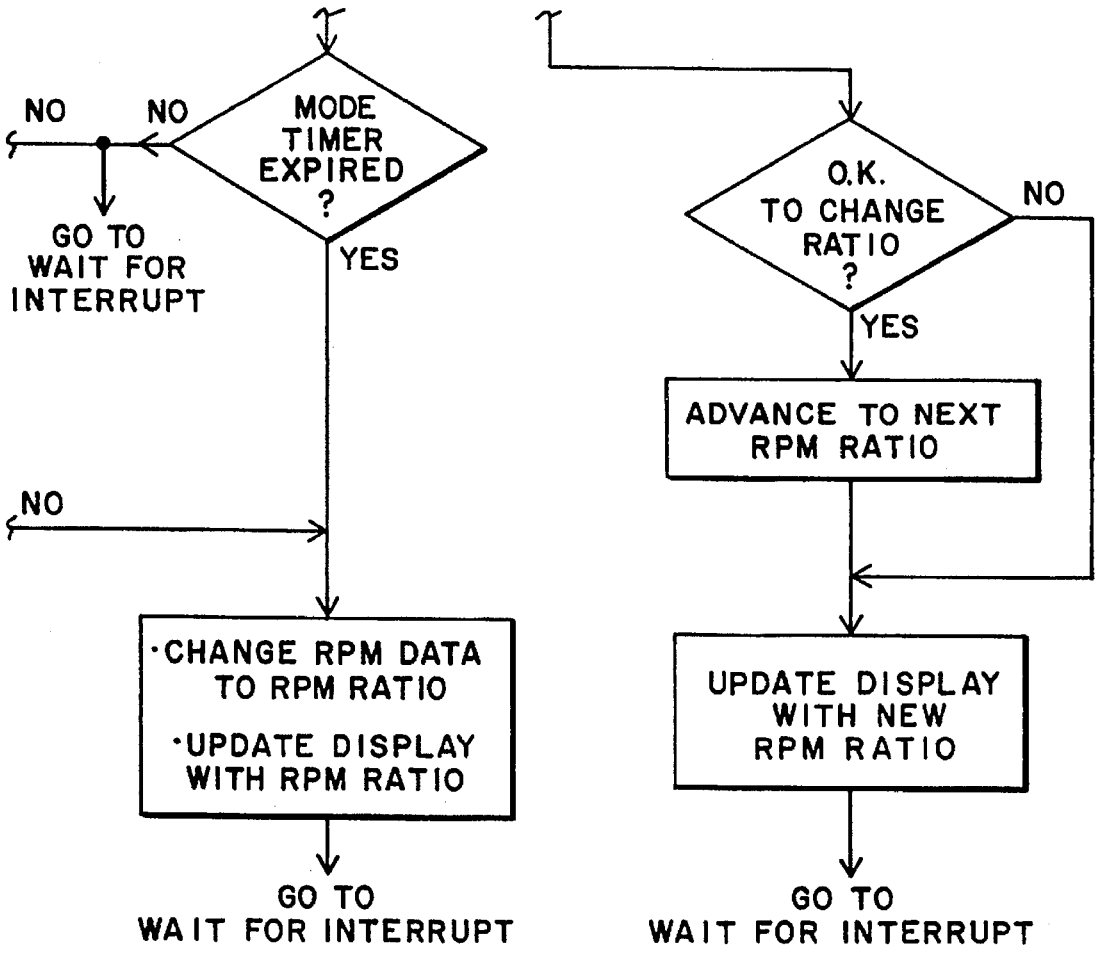

The RPM routine has two entry points, as shown in FIG. 14A. From the set-up entry point, a P-timer is set to three seconds. The monitor determines whether the RPM option is installed. If not, control returns to the mode button routine. If the RPM option is installed, the RPM data register is initialized to the current RPM and control is switched to display the selected one of the current, maximum, zero maximum, or RPM ratio.

If the current RPM is selected, the display is updated from the current RPM buffer. The tachometer mode is then set. If the P-timer has not expired, the ratio (mode) is displayed. If the P-timer has expired, the mode button is sensed. If the mode button is not pushed, the mode timer is initialized to 3 seconds. If the mode button is pushed, the mode timer is checked and if it has not expired, control returns to wait for interrupt. If the mode timer has expired, that is if the mode button has been pushed for more than 3 seconds, the which RPM data to display switch is changed to maximum RPM, and data type change is inhibited. The display is updated from the maximum RPM buffer, and the mode timer is initialized to 6 seconds. Flow returns to wait for interrupt. In the display maximum display mode, the mode timer is sensed. If the mode timer has not expired, the flow reverts to wait for interrupt. If the mode timer has expired, the 0 maximum RPM jumper is sensed. If the zero maximum function is enabled, the RPM data register is zeroed, the display is updated with zeros, the maximim RPM buffer is set to 0, and the mode timer is initialized to 3 seconds. Flow then returns to wait for interrupt.

If the zero maximum RPM function is not enabled, the RPM data switch is changed to RPM ratio, and the display is updated with the RPM ratio. Flow then returns to wait for interrupt. What we refer to here as the RPM ratio is the same as the tachometer mode discussed in connection with FIG. 10.

From the zeroed maximum display switch, the mode timer is checked. If the mode timer has not expired, control reverts to wait for interrupt. If the mode timer has ,expired, then again the RPM data is changed to RPM ratio and the display is updated with the new ratio and flow returns to wait for interrupt.

From the RPM ratio display branch, the change ratio jumper is sensed. If change ratio is enabled, the next RPM ratio is selected and the display is updated with the new ratio. If the ratio change jumper is not enabled, the display is updated but with the same ratio and in either case flow returns to wait for interrupt.

Figure 15:
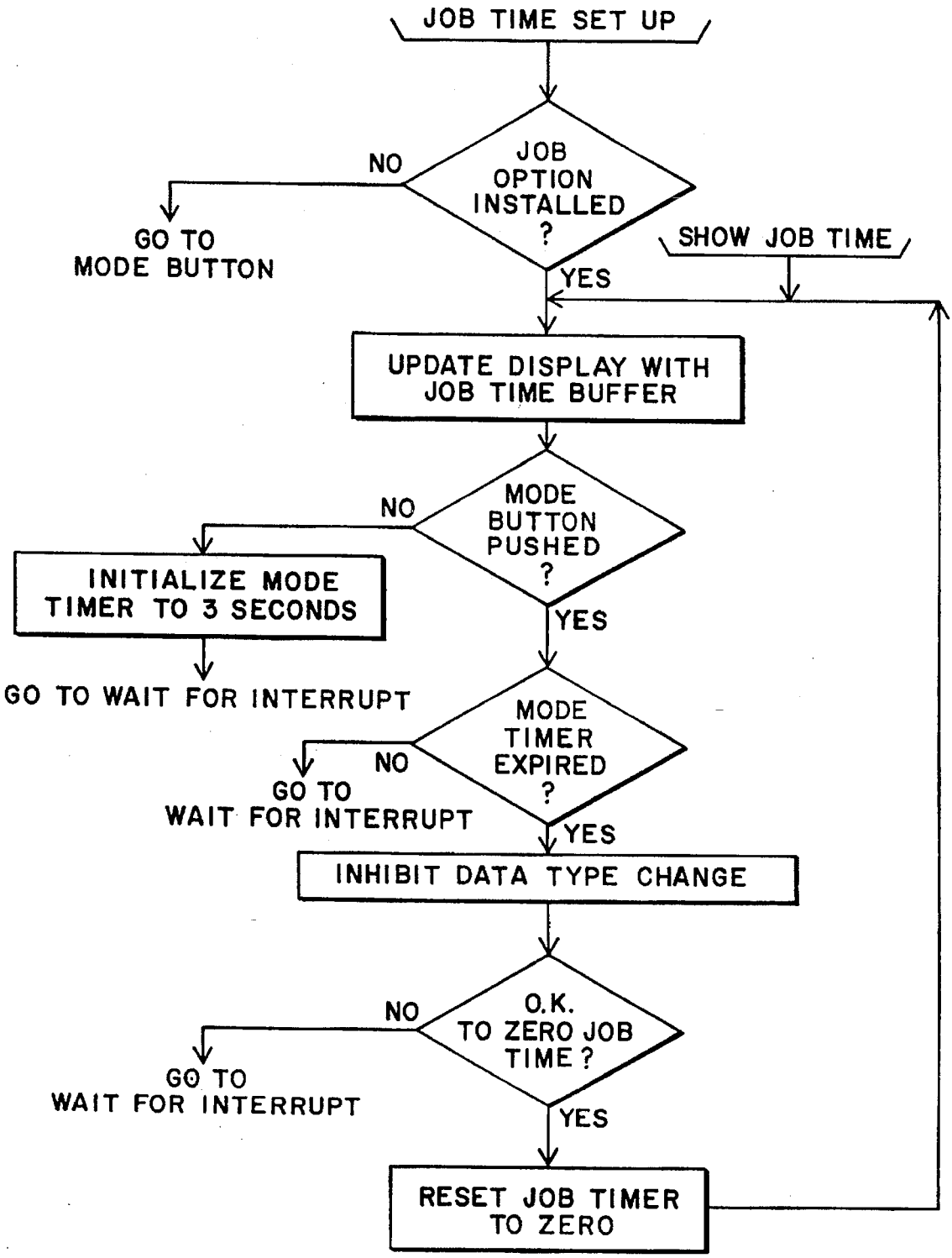

The job time set-up routine appears in FIG. 15. The routine has two entry points, job time set-up and show job time. From job time set-up, the job time option jumper is checked and if the job time option is not enabled, flow returns to the mode button routine. If the job option is installed, the display is updated from the job time buffer, and the mode button is sensed. If the mode button is not pushed, the mode timer is initialized to 3 seconds, and flow returns to wait for interrupt. If the mode button is pushed, the mode timer is checked. If it has not expired, flow returns to wait for interrupt. If it has expired, then 3 seconds has passed, data type change is inhibited, and the okay to zero job time terminal is sensed. If enabled, either directly or because an external signal for zeroing job time is present, the job timer is reset to 0, the display is updated, and if the mode button is no longer pressed, the mode timer is initialized to 3 seconds and flow returns to wait for interrupt.

Figure 16:
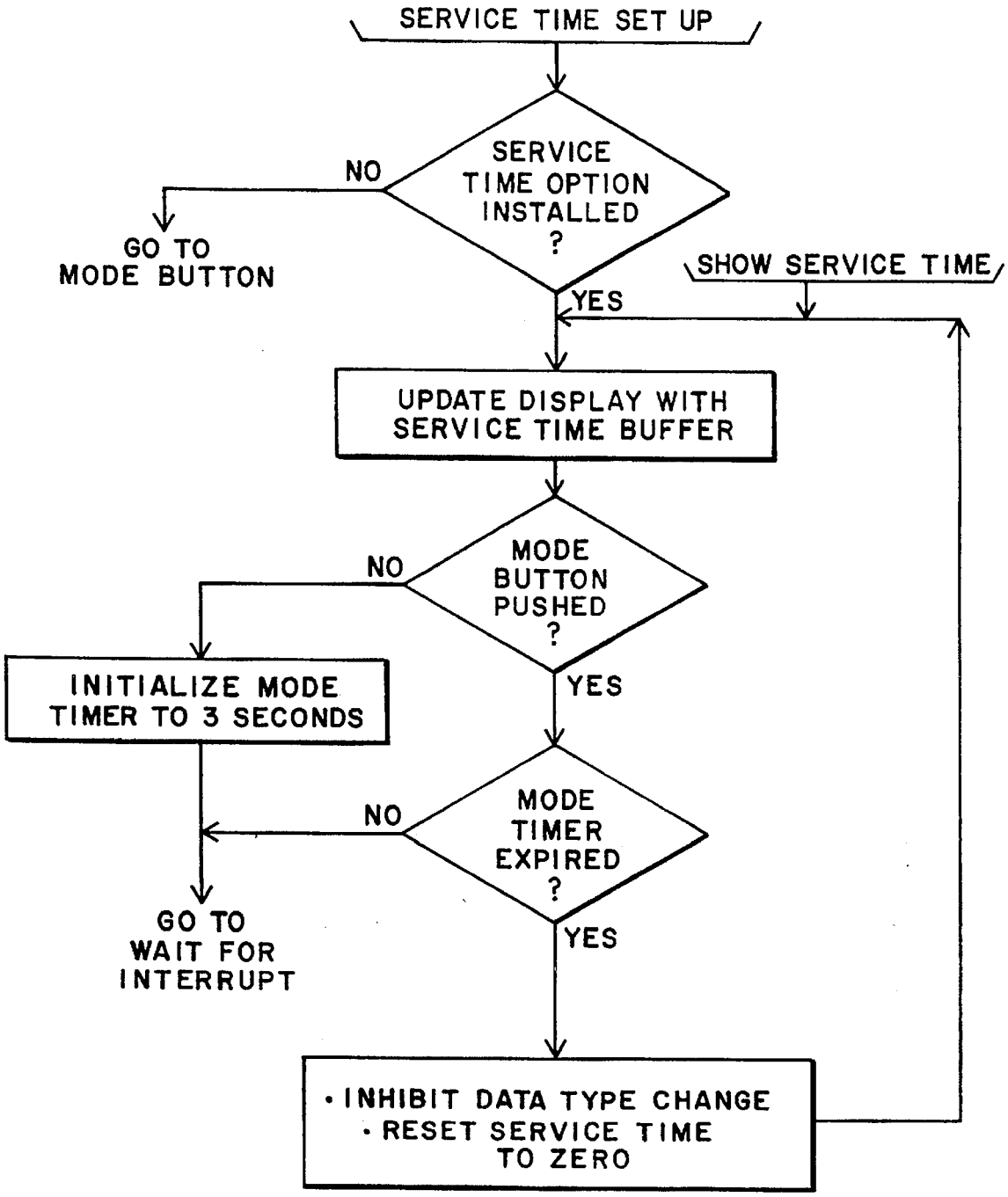
Figure 17:
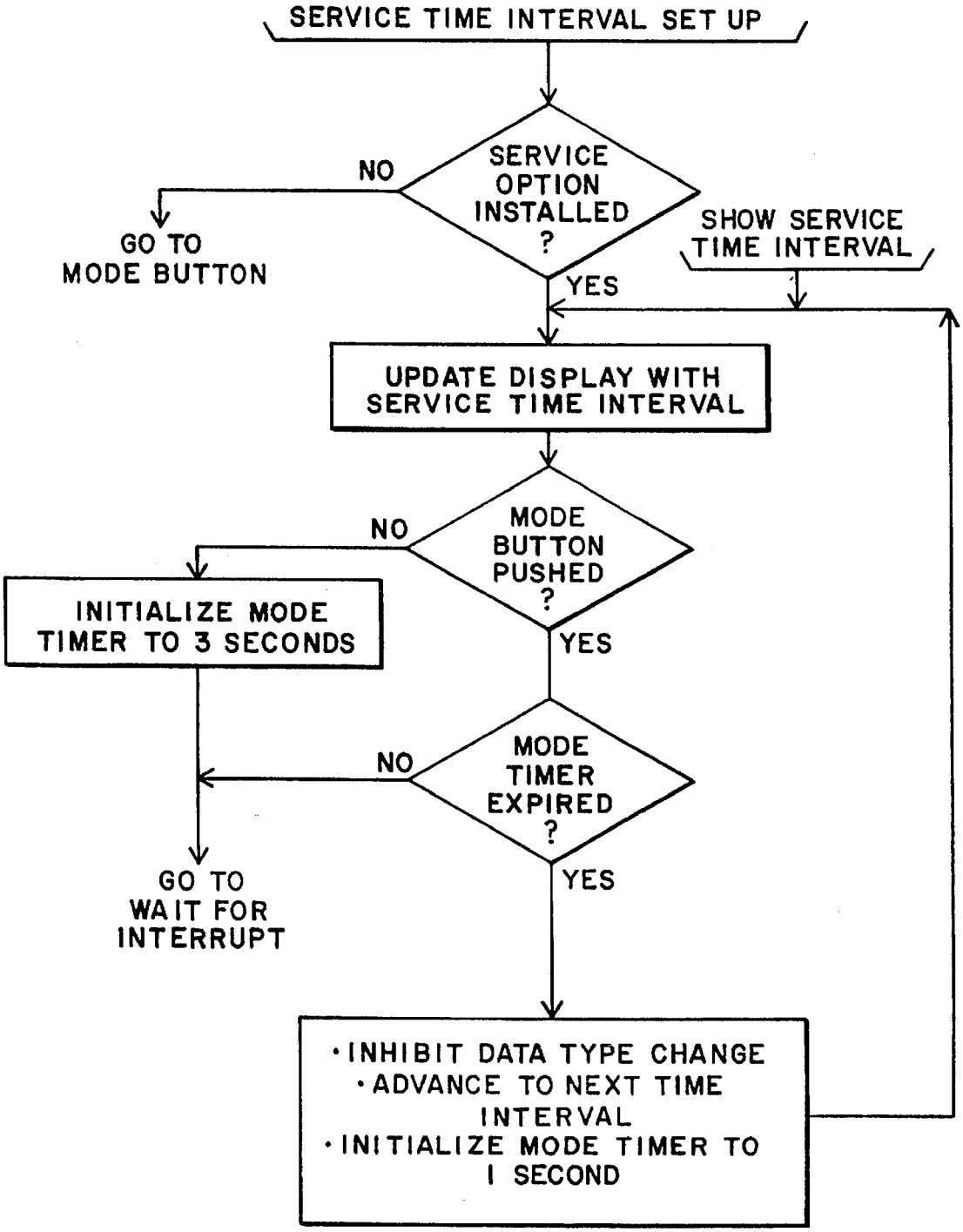

The service time set-up routine shown in FIG. 16 has 2 entry points. From service time set-up, the service time option jumper is sensed. If it is not present, flow returns to the mode button routine. If the service time option is installed, the display is updated from the service time buffer, and the mode button is sensed. If the mode button is not pushed, the mode timer is initialized to 3 seconds, and flow returns to wait for interrupt. If the mode button is pushed, the mode timer is checked and if the mode timer has expired, that is if more than 3 seconds has elapsed, data type change is inhibited, and the service time is reset to 0. The display is updated and assuming the mode button is no longer pushed, the mode timer is reinitialized to 3 seconds and control reverts to the wait for interrupt routine.

The service time interval set-up routine appears on page 17. This routine has two entry points, the set-up entry point and the show service time interval entry point. From the set-up entry point, the service option jumper is checked, and if the service option is not installed, flow returns to the mode button routine. If the service option is installed, the display is updated with the current service time interval. If the mode button is not pushed, the mode timer is initialized to 3 seconds, and flow returns to the wait for interrupt routine. If the mode button is pushed, the mode timer is checked, and if it has expired, indicating that the mode button has been pushed for more than 3 seconds, data type change is inhibited and the service time interval is advanced to the next interval. The mode timer is then initialized to 1 second, and the display is updated with the new service time interval. If the mode button is still pushed, and the mode timer has expired, that is if one second has passed, the time interval is advanced again, the mode timer is reset, and this cycle continues as long as the mode button is still pushed, allowing the service time interval to be cycled through its complete range. Once the mode button is released, the mode timer is initialized to 3 seconds, and flow returns to the wait for interrupt routine.

While the invention has been described in connection with a presently preferred embodiment thereof, those skilled in the art will recognize that many modifications and changes could be made therein without departing from the true spirit and scope of the invention, which accordingly is intended to be defined solely by the appended claims.

What is claimed is:

1. An engine monitor for an internal combustion engine having at least one spark plug comprising:

a substantially weather resistant case;

a spark detector within the case capacitively coupled to the engine through the case and having an input terminal, located adjacent to an outside wall of the case, and responsive to electro-magnetic radiation produced when the spark plug is fired;

a clamp on an outside wall of the case including a channel for forming a loop at the end of an antenna wire close to the input terminal for capacitively coupling a spark signal from the antenna wire through the case to the input terminal; and a clock within the case, responsive to the spark detector for accumulating running time while the engine is running.

2. The engine monitor of claim 1 comprising a display within the case for displaying the running time of the engine.

3. The engine monitor of claim 2 comprising means responsive to the spark detector for determining the rpm of the engine and displaying the rpm on the display.

4. An engine monitor for an internal combustion engine having at least one spark plug comprising a substantially weather resistant case;

a spark detector within the case capacitively coupled to the engine through the case for detecting the presence of an electrical signal produced when the spark plug is fired;

a clock within the case responsive to the spark detector for accumulating running time while the engine is running;

a display within the case for displaying the running time of the engine;

means responsive to the spark detector for determining the RPM of the engine and displaying the RPM on the display; and a switch for switching the display between running time and RPM.

5. The engine monitor of claim 4 comprising a resettable auxiliary timer connected to the switch, for accumulating job time, and a mode selector connected to the switch for switching the monitor among running time, rpm and job time.

6. The engine monitor of claim 5 comprising a service timer that can be set to a selected service interval and which counts down from said service interval while the engine is running, and an alarm for providing an indication when the service interval has elapsed.

7. The engine monitor of claim 6 in which the service timer is connected to the display and the alarm comprises flashing the display.

8. The engine monitor of claim 5 comprising a job time reset signal receiver within the case for receiving a job time reset signal from a transmitter outside the case and enabling the auxiliary timer to be reset only when the job time reset signal is present.

9. The engine monitor of claim 8 in which the job time reset signal receiver comprises a tuned circuit and a detector only responsive to a job time reset signal at a predetermined wavelength.

10. The engine monitor of claim 4 in which the spark detector comprises a signal conditioner for eliminating ringing from the electrical signal produced when the spark plug is fired, to produce one pulse per spark plug firing.

11. An engine monitor for an internal combustion engine having one or more spark plugs comprising:

a first input capacitively coupled to an engine and responsive to signals from the one or more spark plugs for generating an electrical signal each time a spark plug connected to the input fires;

a clock for producing timing signals;

a tachometer coupled to the first input and the clock for determining the RPM of the engine;

a timer coupled to the clock and responsive to the first electrical signal for accumulating the timing signals while the electrical signal is present to provide an output representing the running time of the engine;

a second timer coupled to the clock for accumulating timing signals, and a reset control for setting the second timer to zero; and a display coupled to the timer and the tachometer for displaying the running time and the RPM of the engine.

12. The engine monitor of claim 11 further comprising a memory for storing a maximum RPM reached by the engine and displaying the maximum RPM on the display.

13. The engine monitor of claim 12 comprising a reset control for resetting the maximum RPM.

14. The engine monitor of claim 13 in which the reset control for resetting the maximum RPM and the reset control for resetting the second timer to zero comprise a single push button.

15. The engine monitor of claim 14 in which the maximum RPM is reset to zero only when the external control and the push button are actuated contemporaneously.

16. The engine monitor of claim 12 comprising a control for switching the display between the tachometer for displaying the RPM of the engine and the memory for displaying the maximum RPM.

17. The engine monitor of claim 11 in which the reset control for setting the second timer to zero comprises a control external to the engine monitor and coupled thereto by a wireless connection.

18. The engine monitor of claim 17 comprising delay means responsive to the control external to the engine monitor for setting the timer to zero after a predetermined delay.

19. The engine monitor of claim 11 comprising a third timer and an associated memory for storing a predetermined elapsed time and an alarm connected to the third timer and the associated memory for signaling when the predetermined elapsed time has been reached.

20. The engine monitor of claim 12 comprising a memory for storing information designating the number of cylinders of the engine for converting the electrical signal to RPM.

21. A method for monitoring the running time of an engine that includes a spark plug that fires only when the engine is running, comprising:

providing a free running clock;

capacitively coupling a detector to the engine and to said spark plug for detecting when the spark plug fires; and accumulating time from said free running clock as running time only while the detected electromagnetic radiation indicates that the engine is running.

22. The method of claim 21 further comprising the step of conditioning the signal produced in response to the electromagnetic radiation to provide one pulse per spark.

23. The method of claim 21 comprising accumulating job time in a second accumulator in response to the spark detector and having a reset function for accumulating job time while the engine is running, and providing a reset for setting the second accumulator to zero on demand.

24. The method of claim 21 comprising comparing clock signals to the signals derived from the spark for determining the RPM of the engine.

25. The method of claim 24 further comprising displaying the RPM of the engine.

26. The method of claim 24 comprising comparing each measured RPM to the highest previously measured RPM and continuously storing the highest RPM in a memory.

27. The method of claim 26 comprising providing means for resetting the highest RPM memory.

28. The method of claim 24 comprising providing a service timer having a preset service interval and an alarm for providing an indication when the running time of the engine exceeds the preset service interval.

* * * * *